US008992039B2

(12) United States Patent
Janice

(10) Patent No.: US 8,992,039 B2
(45) Date of Patent: Mar. 31, 2015

(54) LIGHTING APPARATUS WITH DETACHABLE CLIP MOUNT

(75) Inventor: Gregory C. Janice, Shamong, NJ (US)

(73) Assignee: Princeton Tectonics, Bordentown, NJ (US)

( * ) Notice: Subject to any disclaimer, the term of this patent is extended or adjusted under 35 U.S.C. 154(b) by 632 days.

(21) Appl. No.: 13/227,995

(22) Filed: Sep. 8, 2011

(65) Prior Publication Data

US 2012/0057331 A1 Mar. 8, 2012

Related U.S. Application Data

(60) Provisional application No. 61/381,011, filed on Sep. 8, 2010.

(51) Int. Cl.
*F21V 21/084* (2006.01)
*F21L 4/02* (2006.01)
*F21V 21/088* (2006.01)

(52) U.S. Cl.
CPC ..... *F21L 4/02* (2013.01); *F21V 21/0885* (2013.01)
USPC ..... 362/105; 362/106; 362/396; 362/427

(58) Field of Classification Search
CPC ..... F21V 21/30; F21V 21/084; F21V 21/088; F21V 21/0885
USPC ..... 362/105–106, 396, 427
See application file for complete search history.

(56) References Cited

U.S. PATENT DOCUMENTS

| | | | | |
|---|---|---|---|---|
| 6,457,838 | B1 * | 10/2002 | Dugmore et al. | 362/106 |
| 6,575,587 | B2 * | 6/2003 | Cramer et al. | 362/105 |
| 6,616,294 | B1 * | 9/2003 | Henry | 362/106 |
| 6,751,810 | B1 * | 6/2004 | Prendergast | 2/422 |

* cited by examiner

*Primary Examiner* — Sean Gramling
(74) *Attorney, Agent, or Firm* — Howson & Howson LLP

(57) ABSTRACT

In a lighting apparatus comprising a light source housing is pivoted on a clip that can attach alternatively to a head strap adapter or to an adapter secured to a night vision goggle mounting plate. The clip includes a horizontal member having a bracket on the light source housing is rotatable, a pair of spaced, upwardly extending, tabs, and a vertical member extending upward from a location between the tabs. The upwardly extending tabs enter slots on the bottom of the adapter or mounting base, and a rib on the top of the adapter or mounting base is received by a snap fit in a downwardly facing slot on a horizontal part at the upper end of the vertical member of the clip.

10 Claims, 6 Drawing Sheets

LIGHTING APPARATUS WITH DETACHABLE CLIP MOUNT

CROSS-REFERENCE TO RELATED APPLICATION

This application claims priority under 35 USC §119(e) on the basis of provisional application 61/381,011, filed Sep. 8, 2010.

FIELD OF THE INVENTION

This invention relates to lighting apparatus, and particularly to a personal, battery-powered light having a bracket that enables the light to be readily attached to, and removed from, a mounting worn by an individual.

BACKGROUND OF THE INVENTION

Military night vision goggles are attached to a helmet by a device known as a "VAS shroud," VAS being an acronym for "Visual Augmentation System." The VAS shroud is permanently secured to the helmet, and the night vision goggles are attached to the VAS shroud by an adapter known as an NVG plate, which is designed for quick attachment to, and release from, the shroud.

When the night vision goggles are not needed, it is often useful to wear a head-mounted lighting device, i.e., a device emitting a beam of visible light. Many different kinds of such lighting devices, known generally as "personal headlamps," are available, and are generally attached to the person by means of a head strap. It is desirable to provide for pivoting of the light about a horizontal pivot axis to adjust the elevation of the light beam.

SUMMARY OF THE INVENTION

This invention provides for simple, convenient, and secure removable attachment of a pivotable lighting device to a helmet-mounted VAS shroud. Another aspect of the invention is to provide for selective attachment of the lighting device to any of two or more mountings, including a helmet shroud and another adapter such as a head strap adapter. Still another aspect of the invention is to provide for locking of the pivotable lighting device in a position in which its operating pushbutton is in an inaccessible location to prevent accidental activation of the lighting device.

In accordance with the first aspect of the invention, the invention is a lighting apparatus comprising a light source housing, and adapter, and a clip. The housing contains a light source. The adapter comprises a unitary rigid part having an upper rib extending generally in a horizontal direction, and a pair of downwardly open slots aligned with, and spaced from, each other along a direction parallel to the horizontal direction of the rib. These slots are located on opposite sides of a location below the rib. The clip is a unitary, resilient, clip comprising a horizontally extending element having opposite ends and a vertical element having an upper end. The vertical element extends upward from the horizontally extending element at an intermediate location between the opposite ends of the horizontal element. The horizontally extending element of the clip has an ear extending perpendicularly in a forward direction from each of its opposite ends. The horizontal element also has a pair of tabs extending upwardly therefrom on opposite sides of the vertical element. The vertical element has a rearwardly extending part at its upper end, and the rearwardly extending part has a downwardly open slot. The light source housing is rotatable on a bracket for tilting about a horizontal axis. The tabs extending upwardly from the horizontal element are receivable respectively in the downwardly open slots on the adapter, and the downwardly open slot on the rearwardly extending part at the upper end of the vertical element of the clip is positioned to snap onto, and receive, the rib of the adapter when the tabs are received in the downwardly open slots on the adapter. The clip, with the light source housing connected to its bracket, can therefore be attached to the adapter by a snap fit.

The rearwardly extending part at the upper end of the vertical element preferably has a concave, manually engageable, upper surface for detachment of the clip from the adapter, and the upper surface can have serrations formed therein for increased friction when engaged manually by a person's thumb or finger.

The adapter can be designed for attachment to any of various articles. For example, the adapter can be an adapter that connects to a flexible strap such as a head strap, a belt, or to webbing worn on the person. In the case of a helmet, the adapter can be removably attached to a visual augmentation system (VAS) shroud by being connected to a quick release plate that attaches removably to the shroud.

In another aspect of the invention, the light source housing includes a pushbutton for manual activation of the light source, and is rotatable to a pushbutton-protecting position in which the pushbutton is in a substantially inaccessible position between the light source housing and the vertical element of the clip. The bracket and the light source housing include cooperating detents for locking the light source housing in its pushbutton-protecting position. The locking can of the housing in the pushbutton-protecting position can be achieved by an embodiment in which the bracket is a ring-shaped bracket, the light source housing includes a ring having a recess, and the ring-shaped bracket includes a locking tab positioned to enter the recess when the light source housing is rotated to its pushbutton-protecting position. At least one of the ring and the locking tab should have sufficient resilience to allow the locking tab to engage and disengage the recess by application of a torque to the light source housing.

In accordance with another aspect of the invention, the invention is a lighting apparatus kit that includes not only a light source housing and clip together with a first adapter for attachment to a strap, webbing or other support, but also an assembly comprising a mounting plate corresponding to a night vision goggle (NVG) mounting plate, and a second adapter connectible to the plate. The assembly consisting of the light source housing and clip can be quickly connected either to the first adapter or to the second adapter on the NVG mounting plate.

In still another of its aspects, the invention is a lighting apparatus comprising an adapter and a unitary, resilient, clip having a bracket for rotatable support of a light source housing. The adapter is connectible to a quick-release mounting plate capable of attachment to a visual augmentation system shroud on a helmet, and the clip is attachable by a snap fit to the adapter. The quick-release mounting plate includes tabs protruding upward and downward respectively from its upper and lower ends. At least one of said tabs is retractable for release of the mounting plate from a visual augmentation system shroud.

Details, and other advantages of the invention will be apparent from the following description when read in conjunction with the drawings.

DETAILED DESCRIPTION OF THE PREFERRED EMBODIMENTS

Figure 1:
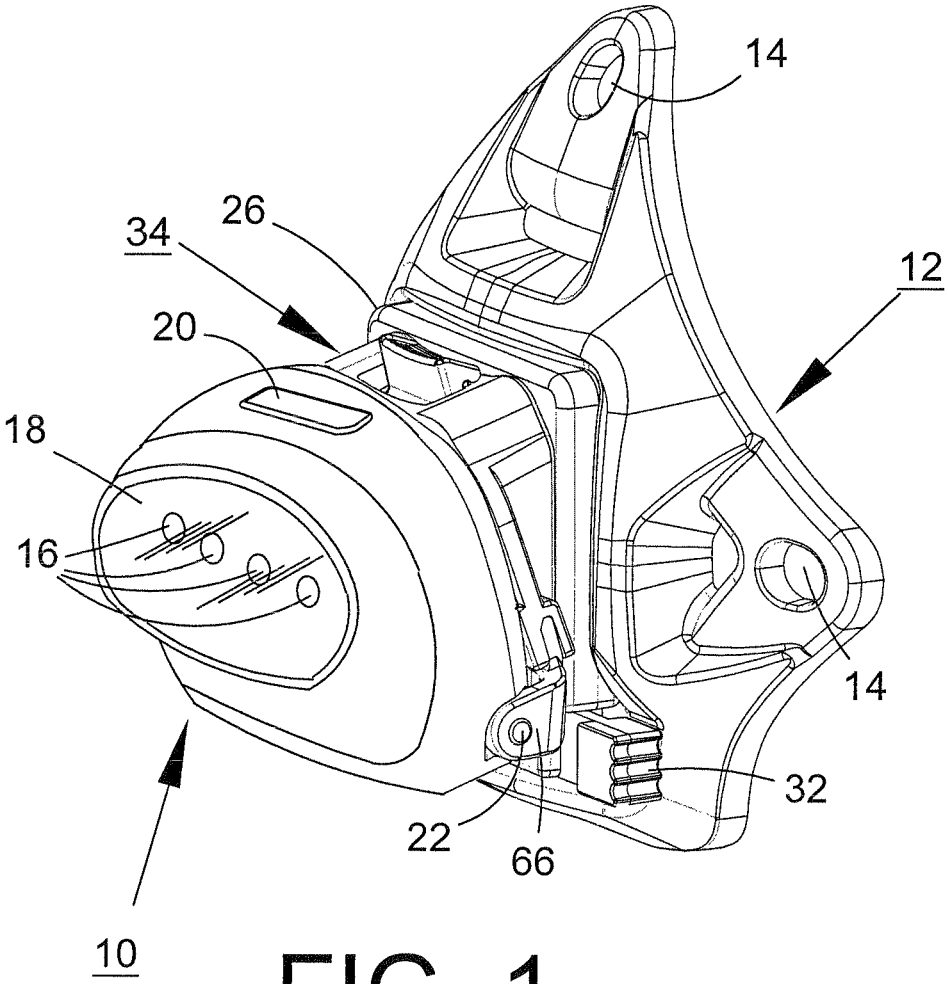
FIG. 1 is a perspective view of an assembly comprising a VAS shroud, a light source housing, a mounting clip and other intermediate components for connecting the light source housing to the VAS shroud.

As shown in FIG. 1, a headlamp comprising light source housing 10, is supported on a VAS shroud 12, adapted to be attached to a military helmet (not shown) by fasteners inserted through fastener holes 14 in the shroud. The headlamp can be any of various portable headlamps. In the embodiment shown, the light source housing includes four light-emitting diodes (LEDs) 16 disposed behind a transparent cover 18. The housing also includes a set of electrochemical cells not shown, an operating push-button 20, and electronic circuitry responsive to the push-button for turning the LEDs on and off, regulating the amount of illumination emitted by the LEDs, ensuring that initial brightness is maintained, and providing for selection of a repeating flashing mode.

The light source housing 10 has a pair of aligned supporting pins extending laterally in opposite directions from locations on the lower parts of the sides of the housing 10. One such pin is pin 22 in FIG. 1. The other pin is not shown in FIG. 1. The pins cooperate with pin-receiving holes in ears protruding forward from the shroud to form a hinge on which the light source housing is pivotable about a horizontal axis corresponding to the direction along which the pins are aligned with each other. A series of detents (not shown in FIG. 1) formed on the back of the housing 10 cooperates with a fixed protrusion to enable the user to select an angular position of the light source from a plurality of available positions.

Figure 2:
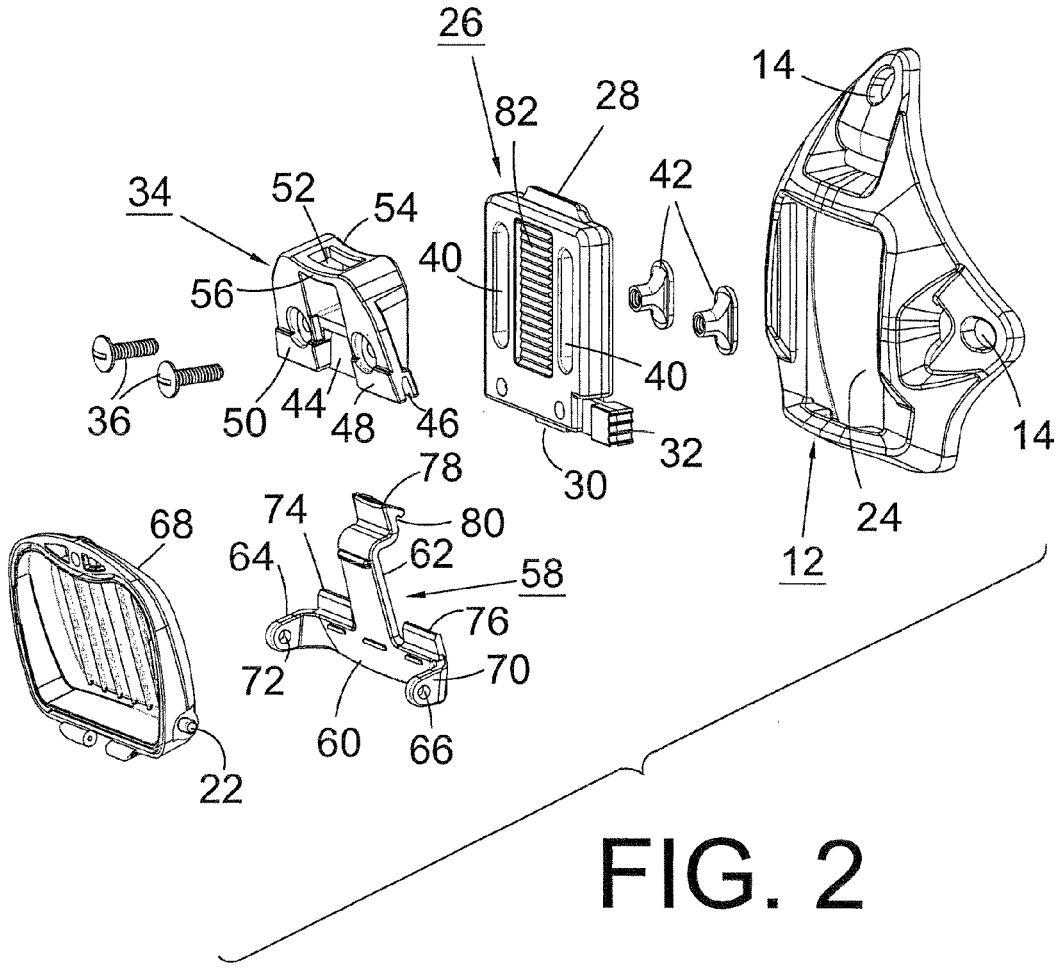
FIG. 2 is an exploded perspective view showing the back cover of the light source housing, the shroud the mounting clip and the intermediate components.

As shown in exploded view in FIG. 2, the VAS shroud 12 has a central opening 24 for receiving a quick-release night vision goggle plate (NVG plate) 26. This plate has a fixed upper tab 28 and a lower tab 30 that can be retracted by operation of a release push-button 32. The tabs 28 and 30 respectively engage upper and lower parts of the shroud 12 to secure the plate to the shroud.

An adapter 34 is secured to the quick release plate by a pair of screws 36, which extend through holes 38 in the adapter and slots 40 in plate 26, and are threaded into T-nuts 42 located in recesses (not shown) in plate 26 behind slots 40.

At the bottom of the adapter 34 are formed two aligned, downwardly open, slots on opposite sides of a gap 44. Slot 46, which is one of the two downwardly open slots, is formed in part 48 on one side of the gap 44, and the other slot, which is similar to slot 46 is formed in part 50 on the opposite side of the gap. The slots are aligned with each other.

The upper part of the adapter 34 has an opening 52 defined between a rear laterally extending rib 54 and a front laterally extending rib 56.

As will be apparent from FIG. 2, the downwardly open slots are located on opposite sides of a location below rear rib 54.

A unitary, resilient, clip 58 comprises a horizontally extending element 60 and a vertical element 62 extending upward from the horizontally extending element at an intermediate location between the opposite ends of the horizontal element. The horizontally extending element has ears 64 and 66 extending perpendicularly in a forward direction from its respective opposite ends. The ears are formed with holes for receiving pins formed on the opposite sides of the back cover 68 of the light source housing. Thus, pin 22 fits into hole 70 in ear 66, and the other pin (not shown) fits into a similar hole 72 in ear 64.

The horizontal element also has a pair of tabs 74 and 76 extending upwardly therefrom on opposite sides of the vertical element 62. The vertical element has a rearwardly extending part 78 at its upper end. The upper surface of part 78 is preferably slightly concave so that it can be firmly engaged by a user's thumb or finger, and may be formed with serrations for increased friction when engaged manually by a person's thumb or finger. A downwardly open slot 80 is formed underneath the rearwardly extending part.

An assembly consisting of the light source housing 10 (FIG. 1) and the clip 58 can be quickly attached to the adapter 34, which will already have been secured to the NVG plate 26, by inserting tabs 74 and 76 into slot 46 and the similar slot in part 50 while passing the upper part of the vertical element 62 upward through gap 44 and opening 52 in adapter 34, and pushing the upper portion of vertical part 62 rearward until part 78 snaps over rear rib 54 and rear rib 54 is engaged with downwardly open slot 80 in part 78.

The assembly consisting of the light source housing and the clip can be removed from the adapter by pressing forward on the inclined surface on the upper side of part 78 to disengage slot 80 from rib 54.

As shown in FIG. 2, NVG plate 26 has a set of teeth 82 which can be selectively engaged by complementary ribs on a night vision goggle assembly for adjustment of the height of the goggles. A similar adjustment of the height of the light source housing is less critical but nevertheless possible, and the adapter 34 is provided with a set of teeth for engagement with teeth 82 on plate 26.

The light source can be mounted on the VAS shroud when the shroud is not being used to support night vision goggles. The light source can be attached and removed in either of two ways. It can be attached and removed by manipulating the clip 58 to attach and remove the assembly consisting of the clip and the light source housing to and from the adapter 34. Alternatively, the assembly consisting of the light source housing, the clip, the adapter and the NVG plate can be attached to and removed form the shroud 12 by manipulation of push button 32.

Figure 3:
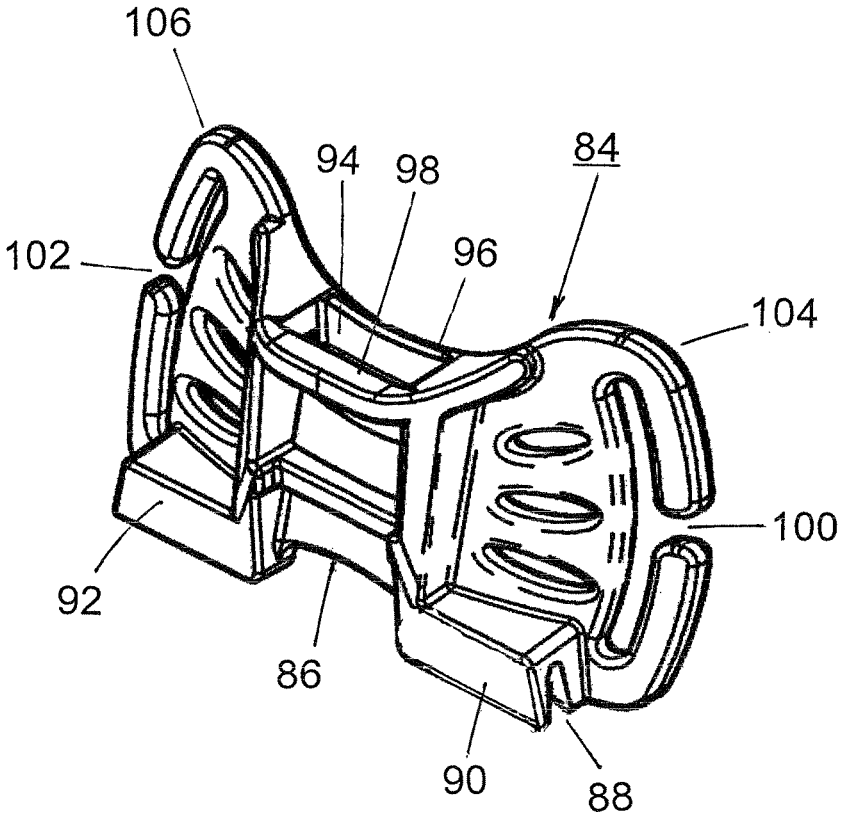
FIG. 3 is a perspective view of a adapter for connection to the clip in order to mount the light source on a headstrap instead of on a helmet.

The use of the clip provides for convenient transfer of the assembly consisting of the light source housing and the clip from the adapter 34 to an alternative adapter 84 as shown in FIG. 3.

Adapter 84 is preferably a unitary molded device having a construction similar to that of adapter 34. Two aligned, downwardly open, slots are provided on opposite sides of a gap 86. One such slot, 88, is formed in an part 90, and the other slot (not shown but similar to slot 88) is formed in part 92 on the opposite side of the gap. The slots are aligned with each other.

The upper part of the adapter 84 has an opening 94 defined between a rear, laterally extending, rib 96 and a front laterally extending rib 98. The downwardly open slots are located on opposite sides of a location below rear rib 96. T-shaped slots 100 and 102 are provided in flanges 104 and 106 respectively to receive a headstrap (not shown), which can be an adjustable strap woven from a stretchable yarn.

Figure 4:
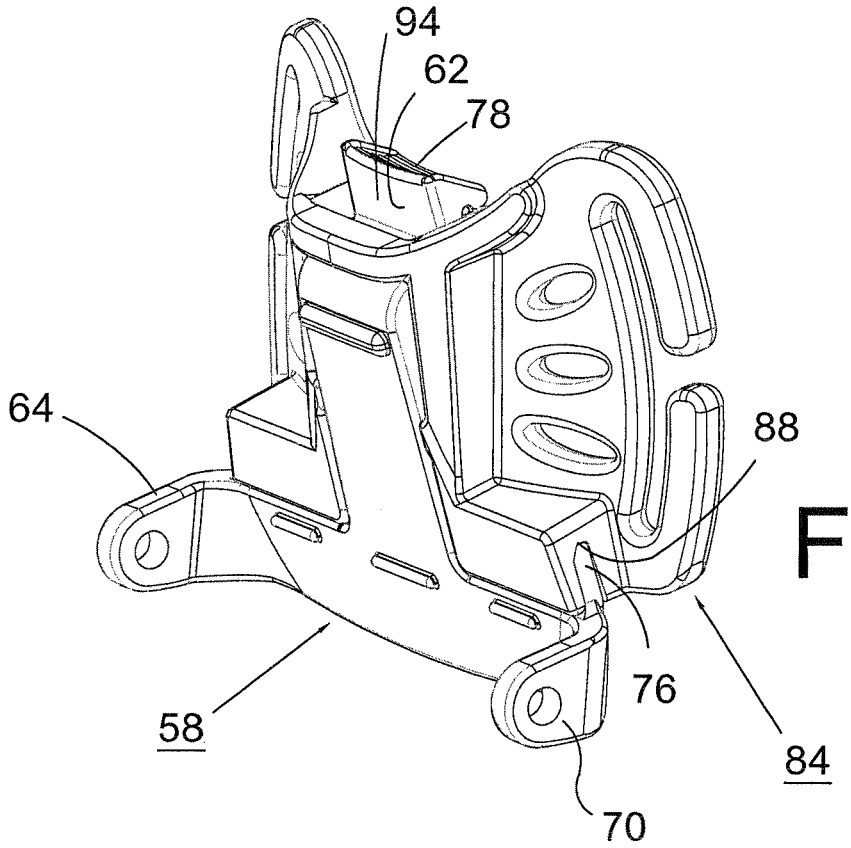
FIG. 4 is a perspective view of an assembly according to a second embodiment, comprising a clip connected to an adapter.
Figure 5:
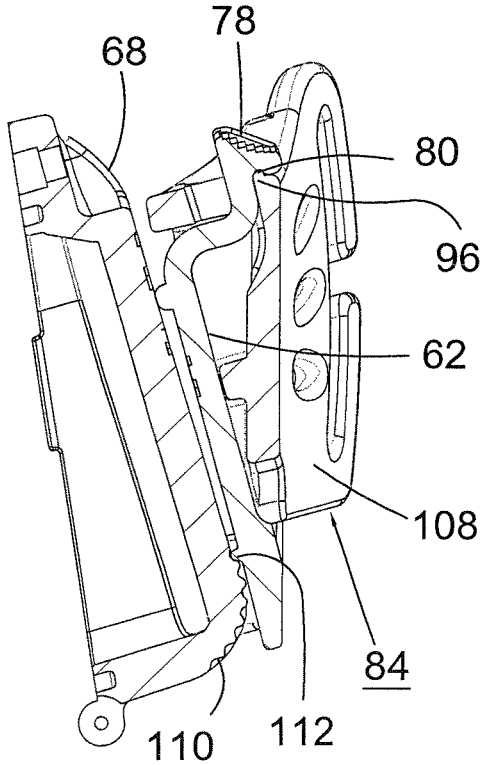
FIG. 5 is a sectional view showing details of the construction of the clip and adapter, and also showing the back cover of a light source housing attached to the clip.

FIGS. 4 and 5 illustrate the attachment of the clip 58 to adapter 84. As in the case of adapter 34, the clip 58, with the light source housing attached to it, can be attached to adapter 84 by insertion of the upper end of its vertical part 62 upward through opening 94 while at the same time inserting its tabs 74 and 76 into the downwardly open slots in parts 90 and 92, and then pushing part 78 so that its downwardly facing slot 80 receives rib 96. The clip can be removed from adapter 84 by pressing forward on the upper part 78 of the clip. As shown in FIG. 5, the rib 96 is configured so that the part thereof that enters slot 80 underneath part 78 of the clip is located slightly forward of the back face 108 of the adapter 84. This configuration of the rib allows the clip to engage the rib without the tip of part 78 pressing into the user's forehead.

As shown in FIG. 5, the back cover 68 of the light source housing is provided with a series of detents 110 arranged on an arcuate portion of the back cover centered on the connecting pins (not shown) on which the light source housing is pivoted. These detents cooperate with a protrusion 112 formed on the clip 62 to hold the light source housing at any selected one of several discrete angles.

From the foregoing, it will be seen that the clip allows the light source housing to be transferred quickly and easily from one adapter to the other so that it can be mounted on the NVG shroud on a helmet or alternatively on a similar to the headstrap of a conventional personal headlamp.

Figure 6:
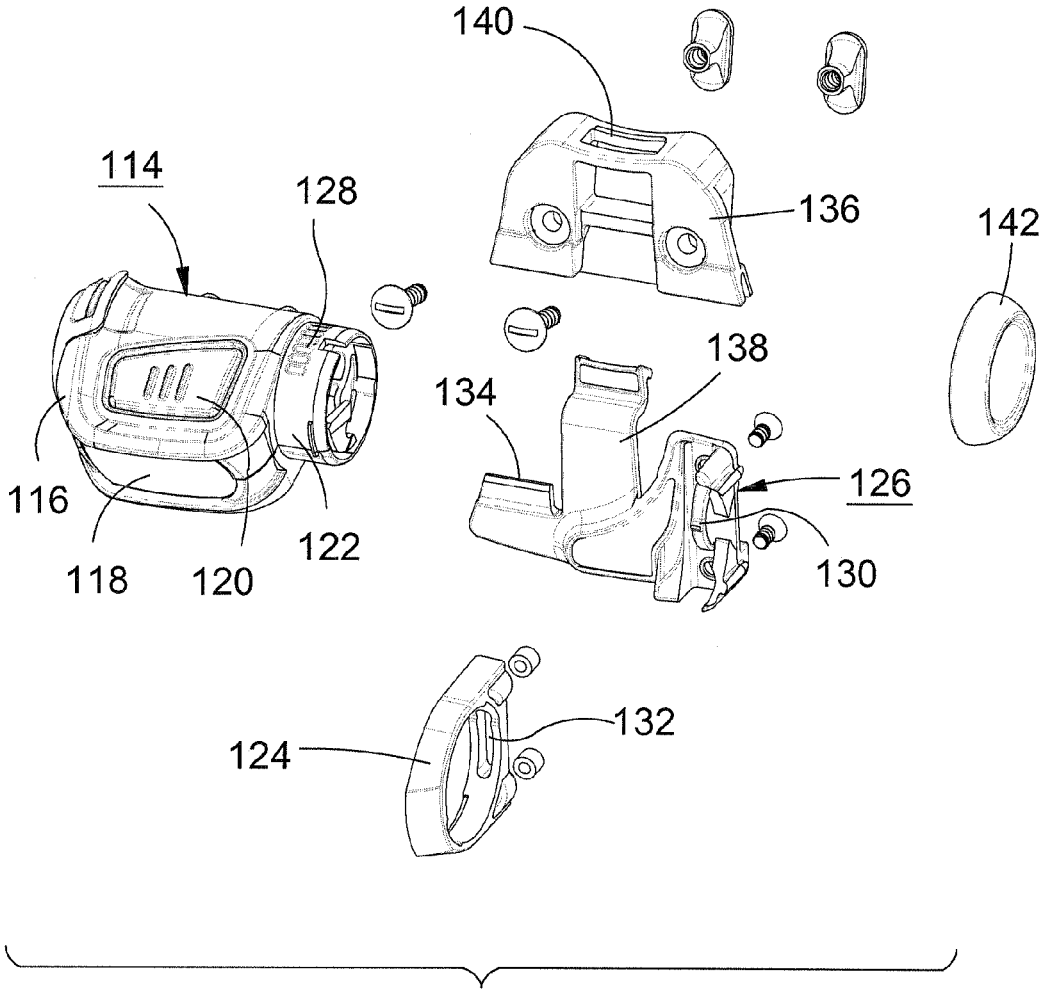
FIG. 6 is an exploded perspective view showing a third embodiment of the invention.
Figure 7:
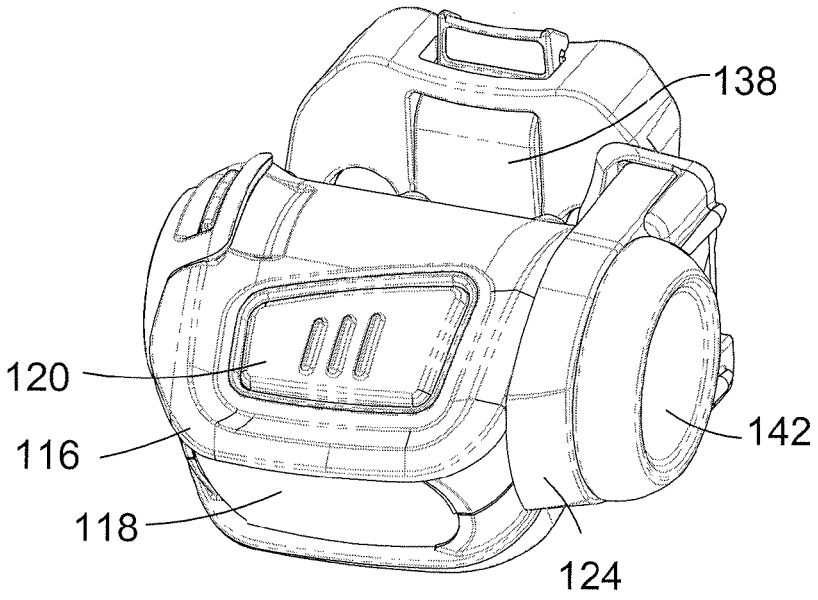
FIG. 7 is a perspective view showing an assembled lighting apparatus according to the third embodiment.
Figure 8:
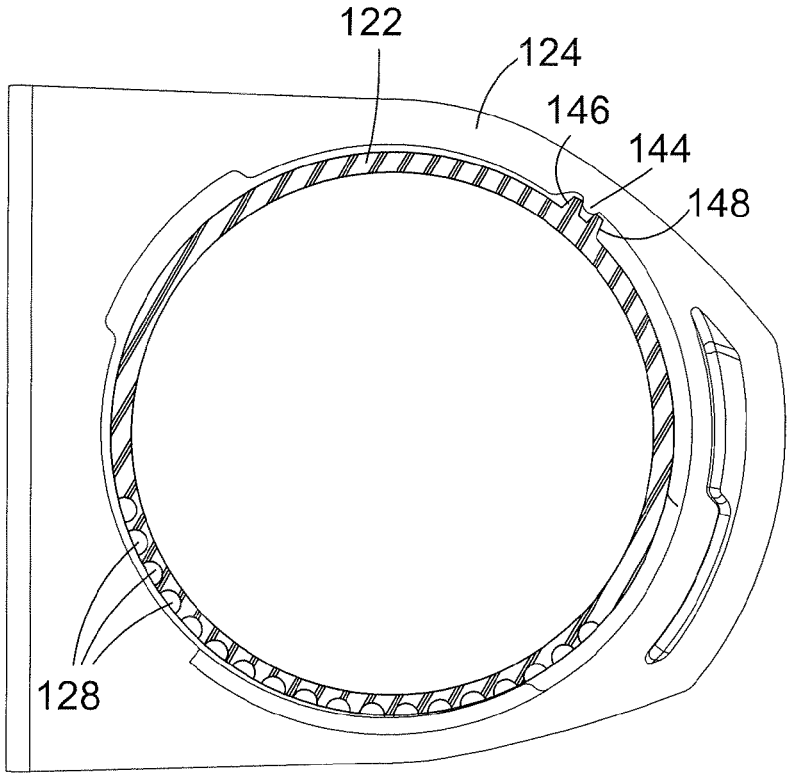
FIG. 8 is a cross-sectional view showing cooperating locking tabs for maintaining the light housing in the third embodiment in an upright condition so that the push-button is inaccessible.

In the third embodiment, shown in FIGS. 6-8, the lighting device is mounted for tilting up and down by engagement of a ring formed at one end of the lighting device with a bracket in the form of a collar extending forward from a clip. The lighting device is similar to the lighting device shown and described in U.S. Pat. No. 7,568,812, granted Aug. 5, 2009. The disclosure of U.S. Pat. No. 7,568,812, is here incorporated by reference.

As shown in FIG. 6, the lighting device 114 includes a light source housing 116 for containing light emitting diodes, power supply cells, and control circuitry, a lens 118, through which light from one or more light emitting diodes (not shown) is emitted, an operating push-button 120 located on top of the housing 118, and a mounting ring 122 extending from one end of the housing for rotation in a ring-shaped bracket 124, which is secured to, and extends forward from, a clip 126. A series of notches 128 is provided on the outside of the ring 122 for engagement with a resilient protrusion 130 on the clip to hold the light at a selected tilt angle. Protrusion 130 extends through a slot 132 in bracket 124. As in the first embodiment, a pair of upright tabs, including tab 134, engage downwardly open slots (not shown) formed in the bottom of an adapter 136, which is similar to adapter 34 in the first embodiment. A resilient element 138, protruding upward from the lower part of clip 126, can extend through slot 140 in adapter 136 to secure the clip temporarily to the adapter. An end cap 142 closes the opening of ring 122 when the device is fully assembled as shown in FIG. 7.

In order to prevent activation of the lighting device by accidental operation of pushbutton 120, the device 114 can be tilted upward and held in the upwardly tilted position so that the pushbutton is in a pushbutton-protecting position between the housing 116 and the resilient element 138 of the clip 126, and therefore prevented from accidental operation by contact with objects such as tree branches, or from accidental operation when packed with other objects in a backpack, for example.

As shown in FIG. 8, detents are provided to lock the light source housing in the pushbutton-protecting position. The internal surface of the ring-shape bracket 124 is formed with an inwardly protruding tab 144, which enters a gap between two adjacent outwardly protruding tabs 146 and 148 formed on ring 122 when the lighting device is tilted upward to a position in which the push-button is protected. Resilience of the ring 128, or resilience of the tab, allow the tab 144 to engage with and disengage from the gap between tabs 146 and 148. The individual user can therefore readily tilt the lighting device upward to a position in which the pushbutton is substantially inaccessible, that is either inaccessible or accessible only with difficulty, and the lighting device will be held in that condition by tab 144 until a torque is applied sufficient to break the engagement of tab 144 with the gap between tabs 146 and 148. The size and relationship of these tabs, and the resilience of the part of the ring 122 adjacent tabs 146 and 148, can be selected so that the torque required to disengage the tabs is sufficient to prevent accidental rotation of the lighting device out of its pushbutton-protecting position. Typically, this torque will be greater than the torque required to adjust the angle of the light by disengaging a notch 128 from protrusion 130.

The lighting device, clip and bracket shown in FIG. 6 can be used with a headstrap adapter similar to the adapters shown in FIGS. 3, 4 and 5 instead of with adapter 136.

Numerous modifications can be made to the devices described. For example, the configuration of the clip can be modified to provide for pivoting of the light source housing about a vertical or oblique axis, or for universal adjustment of the direction of the light beam. Many other modifications can be made without departing from the scope of the invention as defined by the following claims.

What is claimed is:

1. A lighting apparatus comprising:

an adapter; and a unitary, resilient, clip having a bracket for rotatably supporting a light source housing;

wherein the adapter is an adapter connectible to a quick-release mounting plate capable of attachment to a visual augmentation system shroud on a helmet; and wherein said clip is attachable by a snap fit to the adapter;

said lighting apparatus further including a quick-release mounting plate capable of attachment to a visual augmentation system shroud on a helmet, said quick release mounting plate having upper and lower ends, and having tabs protruding upward and downward respectively from said upper and lower ends, in which at least one of said tabs is retractable for release of the mounting plate from a visual augmentation system shroud.

2. A lighting apparatus comprising:

a light source housing containing a light source;

an adapter comprising a unitary rigid part having an upper rib extending generally in a horizontal direction, and a pair of downwardly open slots aligned with, and spaced from, each other along a direction parallel to said horizontal direction, said slots being located on opposite sides of a location below said rib; and a unitary, resilient, clip comprising a horizontally extending element having opposite ends and a vertical element having an upper end, the vertical element extending upward from the horizontally extending element at an intermediate location between said opposite ends;

wherein the horizontally extending element has a bracket extending perpendicularly in a forward direction from at least one of its opposite ends;

wherein the horizontal element also has a pair of tabs extending upwardly therefrom on opposite sides of the vertical element;

wherein the vertical element has a rearwardly extending part at its upper end, the rearwardly extending part having a downwardly open slot;

wherein the light source housing is rotatably connected to said bracket for tilting about a horizontal axis;

wherein the tabs extending upwardly from the horizontal element are receivable respectively in the downwardly open slots on the adapter; and wherein the downwardly open slot on the rearwardly extending part at the upper end of the vertical element of the clip is positioned to snap onto, and receive, the rib of the adapter when said tabs are received in the downwardly open slots on the adapter, whereby the clip, with the light source housing rotatably connected to said bracket, can be attached to the adapter by a snap fit.

3. A lighting apparatus according to claim 2, in which the rearwardly extending part at the upper end of the vertical element has a concave, manually engageable, upper surface for detachment of the clip from the adapter.

4. A lighting apparatus according to claim 3, in which the concave, manually engageable, upper surface has serrations formed therein for increased friction when engaged manually by a person's thumb or finger.

5. A lighting apparatus according to claim 2, including an article adapted to worn on the head of a person, and in which the adapter is attached to said article.

6. A lighting apparatus according to claim 5, in which said article is a flexible strap and the plate of the adapter is attached to said flexible strap.

7. A lighting apparatus according to claim 5, in which said article is a helmet, and in which the adapter is removably attachable to said helmet.

8. A lighting apparatus according to claim 5, in which said article is a helmet having a visual augmentation system shroud, and in which the adapter is removably attachable to said shroud.

9. A lighting apparatus according to claim 2, in which said light source housing includes a pushbutton for manual activation of the light source, wherein the light source housing is rotatable to a pushbutton-protecting position in which the pushbutton is in a substantially inaccessible position between the light source housing and said vertical element, and wherein the bracket and the light source housing include cooperating detents for locking the light source housing in said pushbutton-protecting position.

10. A lighting apparatus according to claim 9, in which the bracket is a ring-shaped bracket, in which the light source housing includes a ring having a recess, and the ring-shaped bracket includes a locking tab positioned to enter said recess when the light source housing is rotated to its pushbutton-protecting position, at least one of said ring and said locking tab having sufficient resilience to allow the locking tab to engage and disengage the recess by application of a torque to the light source housing.

* * * * *